US011573063B2

(12) United States Patent
Plachy

(10) Patent No.: US 11,573,063 B2
(45) Date of Patent: Feb. 7, 2023

(54) BODY OF THE GAS POWERED GUN WITH NO LOSS-MAKING EXPANSION SPACE

(71) Applicant: Altaros Air Solutions s.r.o, Vratislavice nad Nisou (CZ)

(72) Inventor: Ondrej Plachy, Liberec (CZ)

( * ) Notice: Subject to any disclaimer, the term of this patent is extended or adjusted under 35 U.S.C. 154(b) by 73 days.

(21) Appl. No.: 17/195,822

(22) Filed: Mar. 9, 2021

(65) Prior Publication Data

US 2021/0293509 A1 Sep. 23, 2021

(30) Foreign Application Priority Data

Mar. 12, 2020 (CZ) ..... CZ2020-135

(51) Int. Cl.
*F41B 11/00* (2013.01)
*F41B 11/723* (2013.01)
*F41B 11/62* (2013.01)

(52) U.S. Cl.
CPC ..... *F41B 11/723* (2013.01); *F41B 11/62* (2013.01)

(58) Field of Classification Search
CPC ..... F41B 11/723; F41B 11/62; F41B 11/721; F41B 11/60; F41B 11/70; F41B 11/72
USPC ..... 124/71–77
See application file for complete search history.

(56) References Cited

U.S. PATENT DOCUMENTS 4,531,503 A 7/1985 Shepherd
5,063,905 A * 11/1991 Farrell ..... F41B 11/57 124/72
5,078,118 A 1/1992 Perrone
2002/0139362 A1* 10/2002 Shipachev ..... F41A 9/76 124/74
2003/0051717 A1* 3/2003 Hubert ..... F41B 11/721 124/71
2003/0106545 A1* 6/2003 Verini ..... F41B 11/62 124/74
2005/0018371 A1 1/2005 Mladenik et al.
2007/0151551 A1* 7/2007 Verini ..... F41B 11/721 124/74
2008/0060630 A1* 3/2008 Halmone ..... F41B 11/55 124/73
2010/0242939 A1* 9/2010 Halmone ..... F41B 11/721 124/45
2010/0326414 A1* 12/2010 Maeda ..... F41B 11/52 124/74

(Continued)

FOREIGN PATENT DOCUMENTS

EP 3064884 B1 1/2018

*Primary Examiner* — Michael D David
(74) *Attorney, Agent, or Firm* — Cionca IP Law P.C.; Marin Cionca

(57) ABSTRACT

A gun powered by compressed gas with no loss-making expansion space, having: a pressure chamber interconnected with a barrel, and a projectile opening of the barrel at an inlet of the pressure chamber, the pressure chamber and the barrel being mutually lockable by a valve, wherein upon firing the gun: the pressure chamber and the barrel form one space, the valve is connected to a tie rod, and passes through the pressure chamber to a striker space, wherein within the striker space: the tie rod is fitted with a spring, the striker and an end of the tie rod are equipped with a stop, and the spring is positioned in the striker space between the striker and a special section wall, and wherein: the barrel, tie rod, valve, and striker are mounted along one axis, and the valve is controlled by the striker via the tie rod.

14 Claims, 5 Drawing Sheets

(56) References Cited

U.S. PATENT DOCUMENTS

Figure 1:
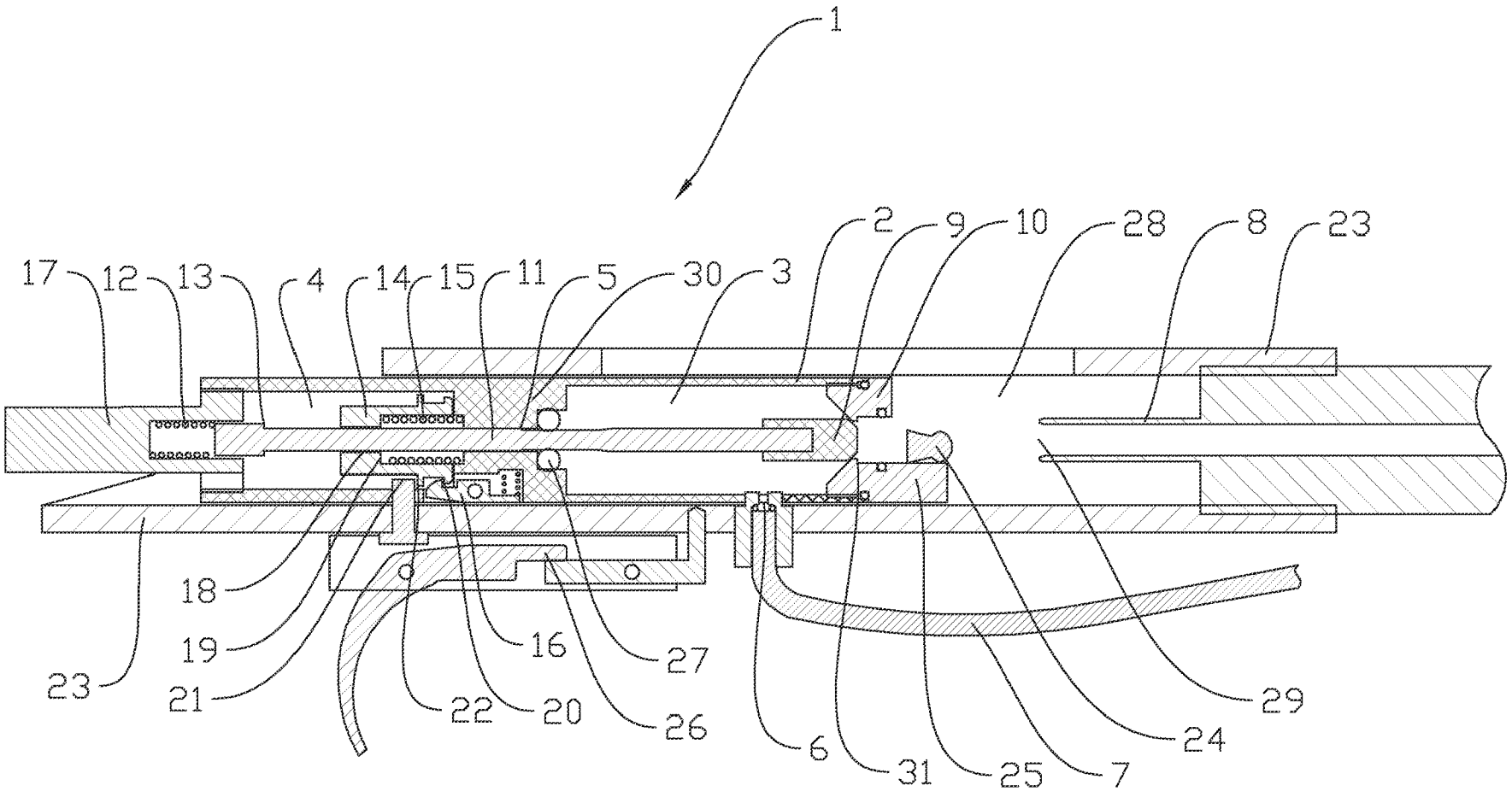

| | | | | |
|---|---|---|---|---|
| 2012/0129136 | A1* | 5/2012 | Dvorak | F41A 33/06 434/18 |
| 2014/0209082 | A1* | 7/2014 | Stevens | F41B 11/70 124/73 |
| 2015/0035491 | A1 | 2/2015 | Hyde et al. | |
| 2015/0226516 | A1* | 8/2015 | Dvorak | F41B 11/723 124/73 |
| 2016/0146567 | A1* | 5/2016 | Nachefski | F41B 11/62 124/73 |
| 2016/0265870 | A1* | 9/2016 | Rice | F41B 11/721 |
| 2017/0299323 | A1* | 10/2017 | Nachefski | F41A 19/10 |
| 2019/0017860 | A1 | 1/2019 | Hogdahl | |
| 2021/0381797 | A1* | 12/2021 | Buys | F41B 11/73 |

* cited by examiner

BODY OF THE GAS POWERED GUN WITH NO LOSS-MAKING EXPANSION SPACE

FIELD OF THE INVENTION

The invention concerns a gun operated by compressed gas, preferably air. In some embodiments, the gun is provided with a rotating bolt mechanism. This provides a higher efficiency of pressurized medium utilization to fire the projectile from the barrel, allows a very good imitation of the appearance of the rifle-type gun to be achieved, easier handling necessary for loading, and simplifies the manufacture of the gun with a reduction of the total size of the striker and valve mechanisms, and a reduction of the number of manufactured components as well.

BACKGROUND OF THE INVENTION

The contemporary gas-operated, in particular air-operated, high-pressure arms (HPA) traditionally employ an arrangement where the feed mechanism located in the barrel axis inserts the projectile into the barrel, where the striker and valve mechanisms are found under the barrel axis with the valve mechanism designed for supplying pressurized medium through an opening in the bottom part of the barrel that is connected to the valve mechanism using a system of channels. It is the mounting of the valve mechanism and barrel in different planes that causes the huge losses of compressive force as the shock pressure of compressed gas travels from the valve to the barrel through a system of channels with a number of edges, non-linearities, and obstacles, which results in the formation of turbulent flow of gas and a loss of a substantial portion of the shock pressure intended for firing. In addition, the system of supply channels also refers to so-called spurious space or loss-making expansion space. The loss-making expansion space means any space between the valve and the projectile, and/or any space that has to be filled by expanding gas before the compressed gas comes into contact with the projectile. Upon firing, meaning after the valve supplying pressurized air into the barrel opens, such loss-making expansion space is filled as the first one due to the fact that after the previous firing, the pressure in the space is at the level of the atmospheric pressure. This results in a decrease in pressure of the compressed gas supplied by the valve. On the other hand, the decrease of pressure is not such to prevent the projectile positioned in the barrel from moving. However, the speed of the projectile is low and the projectile in the barrel moves only slowly. This results in an additional increase of the loss-making expansion space of the gun as the compressed air flowing into the system of channels through the valve must fill up not only the system of channels itself, but also the space in the barrel between the gas supply channels and the projectile that moves in the barrel, thus increasing this space. Only after the entire loss-making expansion space is filled up with compressed gas, kinetic energy can be transmitted to the projectile, which can be then fired out of the barrel using the force required for firing. Such a design of the gun not only decreases the efficiency and effectiveness of the compressed gas shock pressure, but also increases pressurized gas consumption. Such a gun is disclosed for example in the EP 3 064 884 A1 document.

Moreover, attaining the maximum gas flow rate from the system of channels up to the projectile is problematic in commonly used gas powered guns as well. Considering the traditional design of gas powered guns, it is necessary for technical reasons, to have the opening between the supply channels and the barrel smaller than the bore of the barrel concerned to eliminate the projectile entering the system of supply channels.

Another type of the contemporary, however less widespread arrangement, is the variant where the valve mechanism is in the same plane as the axis of the barrel and is also located at a fixed and constant distance from the loading opening of the barrel. To load of such a type of gun, the loss-making expansion space between the valve and the loading opening of the barrel opens and the projectile is positioned manually into the loading opening of the barrel. Then the opened loss-making expansion space is closed, in a majority of cases, it is capped by a sealed hollow cylinder and the gun is ready to fire. After the pressure chamber is opened by the valve, first of all the entire loss-making expansion space must be filled up by gas and only then pressurized gas reaches the projectile, while the loss-making expansion space increases by the slow movement of the projectile in the barrel similarly as in the case of the gas powered gun disclosed above.

In such a type of gun, turbulent flow of compressed gas is significantly limited as the compressed gas does not travel through a system of non-linear supply channels, but the loss-making expansion space of such a gun, defined between the valve and the projectile, or between the valve and the loading opening, respectively, is still large. Therefore, the decrease of compressed gas pressure even in this gun is significant. Another disadvantage of the aforementioned concept is the fact that the projectile must be manually pressed into the loading opening of the barrel and then the loading opening must be closely connected with the valve mechanism by the sliding connecting cylinder, through which the pressurized medium will be flowing from the valve to the back of the projectile. This gun is represented for example, by the AirForce gun, model: Condor.

An example of a similar solution of the arrangement of components can also be found in the US 2005/0183711 document, disclosing a tool for cleaning surfaces, loading of special projectiles or introducing media to places difficult to access, such as tear gas cartridges, insulation material, etc. Such a solution shows a severe disadvantage resting in the decrease of compressed gas pressure before firing. The tool is not controlled by a trigger, but it is controlled by a gas valve allowing gas to be by-passed from the chamber for pressurized gas into the working chamber. To fire, a portion of the compressed gas from the chamber is by-passed into the chamber, which allows the pressures of gas in both chambers to be equalized. This solution is rather uneconomical as there are great pressure losses and it is not intended for quick control either as the equalization of pressures in both chambers results in a time delay.

The variant of the gun mentioned first is not only utterly ineffective as far as the supply of pressurized gas is concerned, but it is also rather demanding compared to the other variant in terms of manufacture. However, the other variant does not make it possible to insert the projectile into the barrel in a different manner than manually by fingers, which slows down the firing process and diminishes the shooter's comfort at loading another projectile.

The standard gas powered guns have another great disadvantage, namely their inoperability with different pressures of the pressurized gas in the pressurized gas canister. For high pressures of pressurized gas, a great force to open the valve is required, meaning that a stiffer spring must be used in the striker. On the other hand, for lower pressures of pressurized gas in the canister, it is more advantageous to use a less stiff spring in the striker as too large of an opening of the valve results in excessive consumption of pressurized gas without an increase to the projectile performance. This results in a waste of pressurized gas. If the gun is designed as a general-purpose one, at high values of pressure of pressurized gas, approximately within the range from 150 to 200 bar, the valve tends to be throttled by the high pressure of gas as the general-purpose spring of the striker is too weak to withstand such high pressures of gas. This limits the pressurized gas flow rate into the barrel, thus reducing the output of the gun. A disadvantage of both these variants representing the state of the art is also the fact that they do not allow the gun to be designed to resemble the external appearance of standard firearms with a cylindrical rotating bolt, such as those of the Mauser type. Currently, there is no gas powered gun with a movable cylindrical bolt available on the market.

SUMMARY OF THE INVENTION

What is the shortest way required for pressurized air to reach the projectile? To leave out the way completely and insert the projectile in the barrel directly into the pressure chamber. This is the arrangement of the new gas powered gun where the projectile opening of the barrel forms an interface with the pressure chamber, wherein the pressure chamber and the barrel are mutually lockable by a valve and form one space during firing. The striker, valve mechanism, and barrel of the gun are located along one axis, where the striker and valve mechanisms are mounted in a movable bolt cylinder that moves in the axis of the barrel. The striker moves in the opposite direction than that of firing, by which also the valve is opened indirectly, via the valve tie rod, in the direction opposite to that of firing, by which the pressure chamber and the barrel are connected allowing the maximum utilization of the pressure energy of gas with pressurized gas immediately reaching the projectile in the barrel thus firing it out.

Depending on a specific embodiment, such an arrangement minimizes or even eliminates the loss-making expansion space defined between the valve and the projectile, as the barrel is interconnected with the pressure chamber and their interconnection is opened and closed by the valve. The valve and/or the valve seat thus fits closely directly to the projectile opening of the barrel where the projectile is located before firing, or fits closely directly to the inserted projectile, respectively.

The gas powered gun according to the present invention shows a visual resemblance to firearms equipped with a movable bolt cylinder while utilizing a unique gas-operation mechanism. The gas powered gun comprises a bolt cylinder that includes a pressure chamber and striker space. These two spaces are preferably separated by a special section wall and also connected by a port for the valve tie rod, where the port leads through the special section wall. The bolt cylinder comprises the following components:

- pressure chamber fitted with the pressurized gas supply; preferably such gas is supplied from the canister/source of such gas via a flexible hose,
- valve mechanism comprising the valve tie rod spring, valve tie rod, striker stop, valve, and valve seat,
- striker mechanism which includes the striker, striker spring, and striker catch that is preferably fitted with a small spring,
- bolt lock.

The valve tie rod passes through the pressure chamber that is delimited along its perimeter by the bolt cylinder; on the side facing the barrel the pressure chamber is closed in an openable manner by the valve that fits closely to the valve seat and on the side away from the barrel, the pressure chamber is permanently closed by the seal surrounding the passing-through valve tie rod. The seal closing the pressure chamber is preferably located at the inlet into the port for mounting the valve tie rod, which passes through the pressure chamber up to the striker space. The volume of the pressure chamber is variable and depends on the bolt diameter, valve tie rod diameter, and the bolt length. The volume of the pressure chamber can preferably range from 2 to 50 ml, where preferably the pressure chamber with the volume of 2 to 30 ml can be used for small projectile calibers, and the pressure chamber with the volume of 30 to 50 ml can be used for big projectile calibers.

The valve tie rod has the shape of a special section bar or a hollow capped special-section bar, passes through the bolt along its longitudinal axis and along with the striker form the core of the entire gun. The valve tie rod is at its end located in the pressure chamber and facing the barrel fitted with the valve that fits closely to the valve seat. In a preferred embodiment, the valve is self-centring, of a cylindrical shape, with unilaterally bevelled edges, with an inlet contour, where the angle of the bevelled edges of the inlet contour preferably corresponds to the angle of the inlet contour of the valve seat to which the valve closely fits. The seat of the valve includes an opening, preferably centred and circular, for the flow of pressurized gas from the pressure chamber to the barrel. Also preferably, the seat of the valve includes, on its external side in the loading space, a section for the insertion of the barrel and the projectile socket.

In the striker space, through which the valve tie rod passes, the striker spring and the striker are put on the tie rod. In this way, the striker at least partly surrounds the valve tie rod and in a preferred embodiment, the striker has the shape of a special section annulus or a hollow cylinder. The outer case of the striker is fitted with functional sections—a section for the striker catch and a section for the bolt stop. The bolt stop is static within the framework of the gun and is not part of the movable bolt. On the contrary, the striker catch is part of the bolt, in a preferred embodiment it is mounted in the wall of the bolt cylinder and moves together with the bolt. In a preferred embodiment, the inner case of the striker is adapted not only to the through pass of the valve tie rod as it includes the opening for the tie rod, but also to partial or full seating of the striker spring. The striker spring is preferably partly seated in the seat of the striker spring and partly seated in the special section wall separating the pressure chamber and the striker space. The inner diameter of the striker spring is greater than that of the valve tie rod. In a preferred embodiment, the striker spring is preloaded between the special section wall and the striker. In such a case, after the gun assembly, the striker spring is never fully relaxed, just released. Therefore, the wording of the document differentiates between release and relaxation. Upon release, a given spring remains preloaded upon its seating in the gun; it is usually limited by the space and cannot reach the relaxed state. The spring relaxation refers to the state of the spring free of any external forces outside the gun, meaning the length of the spring. If the gas powered gun design does not include a preloaded spring and the inner arrangement of the gun allows the striker spring to reach the relaxed state, in a preferred embodiment a sufficiently stiff spring, for example 65 N and a similar one, is used to impart sufficient energy to the striker to its throwing and driving along the valve tie rod, independently of the striker spring state. The striker spring of this type is sprung up to the relaxed state, during which it transfers its kinetic energy to the striker.

The valve tie rod, on the side opposite to the barrel, is fitted with a projecting striker stop, which can be part of the valve tie rod, or the valve tie rod can be fitted thereon. The valve tie rod together with the valve tie rod spring, that is compressible by the tie rod, are seated in the bolt cylinder lock, where the lock of the bolt cylinder can be either a separate part, or part of the bolt cylinder. In a preferred embodiment, the striker stop is of the annular or cylindrical shape with the outer diameter greater than that of the valve tie rod. The striker stop can be implemented by mere projections on the tie rod.

In a preferred embodiment, the bolt cylinder is manufactured from materials commonly used for parts of gas powered guns; it is preferably made of metal or metal alloys, preferably duralumin, steel, aluminium, brass, or copper.

In a preferred embodiment, the valve tie rod is manufactured from materials commonly used for parts of gas powered guns; it is preferably made of hardened plastic material, metal or metal alloys, preferably duralumin, steel, aluminium, brass, or copper.

In a preferred embodiment, the striker is manufactured from materials commonly used for parts of gas powered guns; it is preferably made of metal or metal alloys, preferably duralumin, steel, aluminium, brass, or copper.

In a preferred embodiment, the valve, valve seat and seals are made of materials commonly used for the manufacture of valve mechanisms, such as flexible or slightly deformable materials, such as rubber, plastic materials, and plastic composites, silicone or Teflon, or polished metals, such as brass or steel.

The body of the gun according to this invention, can be dimensioned while retaining its basic functionality, for example as follows:

In a preferred embodiment, the striker spring seated in the gun is preloaded. If the striker stop on the valve tie rod is positioned in the striker space, then the length (a) of the striker space in the axis of the gas powered gun body is smaller than that (b) of the assembly of the striker—relaxed striker spring plus the distance of the striker stop from the bolt cylinder lock.

In a preferred embodiment, the striker spring seated in the gun is not preloaded but it is fully relaxable (capable of complete relaxation). If the striker stop on the valve tie rod is positioned in the striker space, then the length (a) of the striker space in the axis of the gas powered gun body is larger than that (b) of the assembly of the striker—relaxed striker spring plus the distance of the striker stop from the bolt cylinder lock. By fulfilling this condition, the striker spring seated in the gun will always be preloaded but never fully relaxed.

If the striker stop on the valve tie rod is positioned in the striker space and the length (a) of the striker space in the axis of the gas powered gun body is the same as that (b) of the assembly of the striker—relaxed striker spring plus the distance of the striker stop from the bolt cylinder lock, then the striker spring seated in the gun is relaxable.

In a preferred embodiment, the striker spring in the state after firing presses the striker into contact with the striker stop. If the striker stop is positioned on the valve tie rod in the striker space, then the distance (d) of the striker stop positioned on the valve tie rod from the special section wall is smaller than the length (b) of the assembly of the striker—relaxed striker spring. In a preferred embodiment, the striker spring, and the striker in the state after firing are positioned freely. If the striker stop is positioned on the valve tie rod in the striker space, then the distance (d) of the striker stop positioned on the valve tie rod from the special section wall is greater than the length (b) of the assembly of the striker—relaxed striker spring. In a preferred embodiment, the striker spring, the striker, and the striker stop in the state after firing are positioned in contact. If the striker stop is positioned on the valve tie rod in the striker space, then the distance (d) of the striker stop positioned on the valve tie rod from the special section wall is the same as the length (b) of the assembly of the striker—relaxed striker spring.

If, in a preferred embodiment, the striker stop is positioned on the valve tie rod in the striker space and the length (e) of the assembly valve tie rod fitted with the valve—the released spring of the valve tie rod is preferably the same or greater than the length (f) of the assembly of the pressure chamber—port—striker space—inner space of the bolt cylinder lock, then it is ensured that the valve tie rod passes through the entire bolt cylinder, it is positioned between the valve seat and the bolt cylinder lock, and thanks to the spring of the valve tie rod, it is not moving freely in the bolt cylinder, which means that the spring of the valve tie rod remains preloaded in any event.

SUMMARY

The body of the gas powered gun that is powered by compressed gas with no loss-making expansion space according to the present invention comprises the pressure chamber interconnected with the barrel, where the projectile opening of the barrel is at the inlet of the pressure chamber, where the pressure chamber and barrel are mutually lockable by the valve and upon firing the pressure chamber and the barrel form one space, where the valve is situated on the valve tie rod that passes through the pressure chamber to the striker space, where the valve tie rod is fitted with the striker spring, striker by putting on, and the end of the valve tie rod in the striker space is equipped with the striker stop and the striker spring is positioned in the striker space between the striker and the special section wall separating the pressure chamber from the striker space, and the barrel, valve tie rod, valve, and striker are mounted in one axis, and the valve connecting the pressure chamber and the barrel is controlled by the striker via the valve tie rod.

This arrangement defines the striker movement in the opposite direction than that of firing as the design in the static state eliminates the movement of the striker in the direction of firing, namely for the following reasons:

- the pressure chamber (3) is positioned behind the barrel (8)
- the striker space (4) is separated from the pressure chamber (3) by the special section wall (30)
- the spring (15) of the striker (14) and the striker (14) are mounted in the striker space (4)
- the barrel (8) and the striker (14) are mounted in one axis—meaning that the striker space is situated behind the pressure chamber
- the spring (15) of the striker (14) is mounted between the special section wall (30) and the striker (14)
  - → the arrangement is as follows: barrel, pressure chamber, special section wall, striker spring, striker
- this means that the striker controlled by the striker spring has the only option to move in the opposite direction than that of firing.

In a preferred embodiment, the pressure chamber on the connection with the barrel is equipped with the seat of the valve, the valve fits closely to the seat of the valve upon the pressure chamber closing, and the valve and the seat have corresponding inlet contours.

The pressure chamber is preferably fitted with the supply of pressurized gas that is connected to the source of pressurized gas by a flexible hose.

The pressure chamber, valve, valve tie rod, striker space, striker spring, striker, and striker stop are preferably situated in a movable bolt cylinder that is closed by the bolt cylinder lock with the inserted valve tie rod spring. In a preferred embodiment the bolt cylinder comprises in the loading space the projectile socket that is preferably part of the valve seat. The valve seat preferably comprises a section for the insertion of the barrel.

In a preferred embodiment, the valve tie rod, when passing through the pressure chamber or the special section wall through the port for mounting the valve tie rod, is sealed by the seal and on the side opposite to that where the valve is positioned, and it fits closely to the valve tie rod spring.

The striker spring is preferably partly implanted in the striker, in the seat of the striker spring, and partly implanted in the special section wall separating the pressure chamber from the striker space.

The striker preferably comprises a section for the striker catch connected to the trigger mechanism. In a preferred embodiment, the striker is put onto the valve tie rod through the opening for the tie rod. In a preferred embodiment, the striker comprises a section for the bolt stop and the gas powered gun body comprises the bolt stop.

The gun according to the present invention can be best described by means of the following four stages of the operation cycle:

Loading

Part of the loading process—the opened gun with the loaded projectile is provided in FIG. 1. Similarly to the standard firearms comprising a bolt, the bolt cylinder is displaced in the barrel axis away from the barrel, which results in the exposure of the loading opening of the barrel and opening the loading space for inserting the projectile into the gun. The projectile is inserted manually either directly into the loading space, or it is preferably positioned into the projectile socket, where the projectile socket is positioned in the projectile space, it is part of the movable bolt and is exposed by the bolt displacement away from the barrel. In a preferred embodiment, the gun is fitted with a magazine comprising projectiles where the projectiles are loaded into the gun from the magazine similarly as in the case of standard repeating firearms.

As a result of the displacement of the bolt cylinder away from the barrel, all parts of the bolt are displaced as well, meaning the entire striker mechanism mounted in the bolt cylinder. The striker is moved along with the bolt cylinder until the section for the bolt cylinder stop, positioned on the outer case of the striker, strikes against the static stop of the bolt cylinder, whereby the striker is stopped in its movement, regardless of the fact that the bolt cylinder continues moving away from the barrel. This movement compresses the striker spring positioned in the striker space between the striker and the special section wall separating the pressure chamber from the striker space. The striker with the compressed spring is secured by the striker catch caught by the section for the striker catch positioned on the outer case of the striker.

The bolt cylinder is, along its axis, or along the axis of the barrel, respectively, retracted back to the barrel and the striker mechanism with the compressed striker spring secured by the striker catch moves along with the bolt. The projectile a) has been already positioned in the projectile opening of the barrel, b) is seated in the projectile socket that approaches the projectile opening of the barrel along with the bolt. Thanks to its round shape, the projectile is pressed into the barrel through the edge of the projectile opening of the barrel by the bolt, preferably by the valve seat or the valve.

The movement of the bolt cylinder ends at the moment when the projectile opening of the barrel fits closely to the seat of the valve or the valve.

Pressurized gas continues flowing into the pressure chamber, preferably from the canister or a different source of pressurized gas. In a preferred embodiment, the pressure of gas in the pressure chamber can be controlled by the controller positioned between the pressurized gas canister and the pressure chamber to attain the pressure ranging from 5 to 250 bar, and/or pressure of gas in the pressure chamber is not controlled and corresponds to that in the canister.

Before Firing

Figure 2:
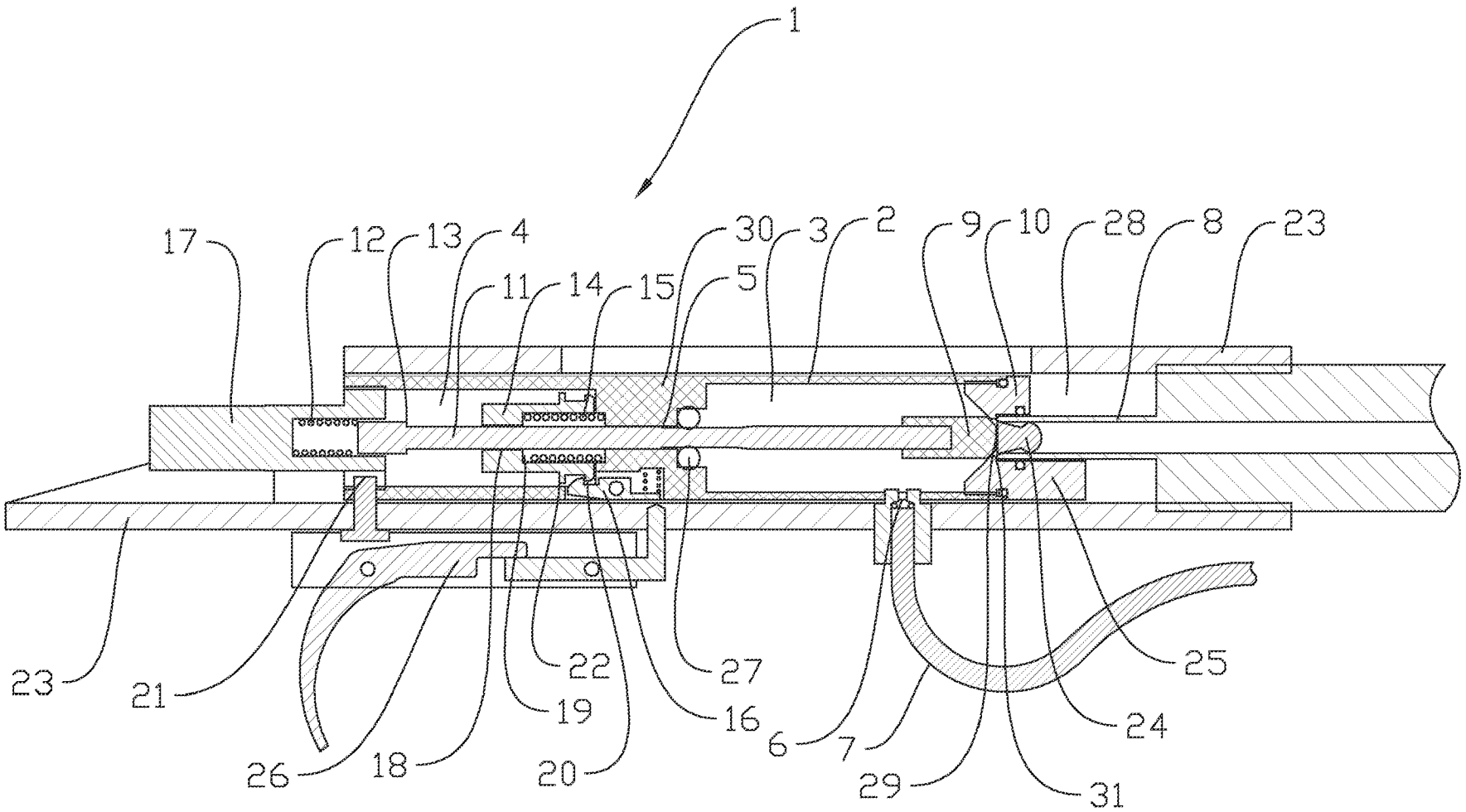

The state of the gun before firing is illustrated in FIG. 2.

The projectile opening of the barrel fits closely to the seat of the valve. At this moment, the projectile fits tightly to the bolt, preferably to the seat of the valve or the valve. If the projectile fits tightly to the valve, the loss-making expansion space of the embodiment is zero. If the projectile fits tightly to the seat of the valve, the loss-making expansion space is extremely minimized. The pressure chamber closed by the valve is filled with pressurized air. The striker mechanism with the compressed spring of the striker is secured. The gun is ready to fire.

Firing

Figure 3:
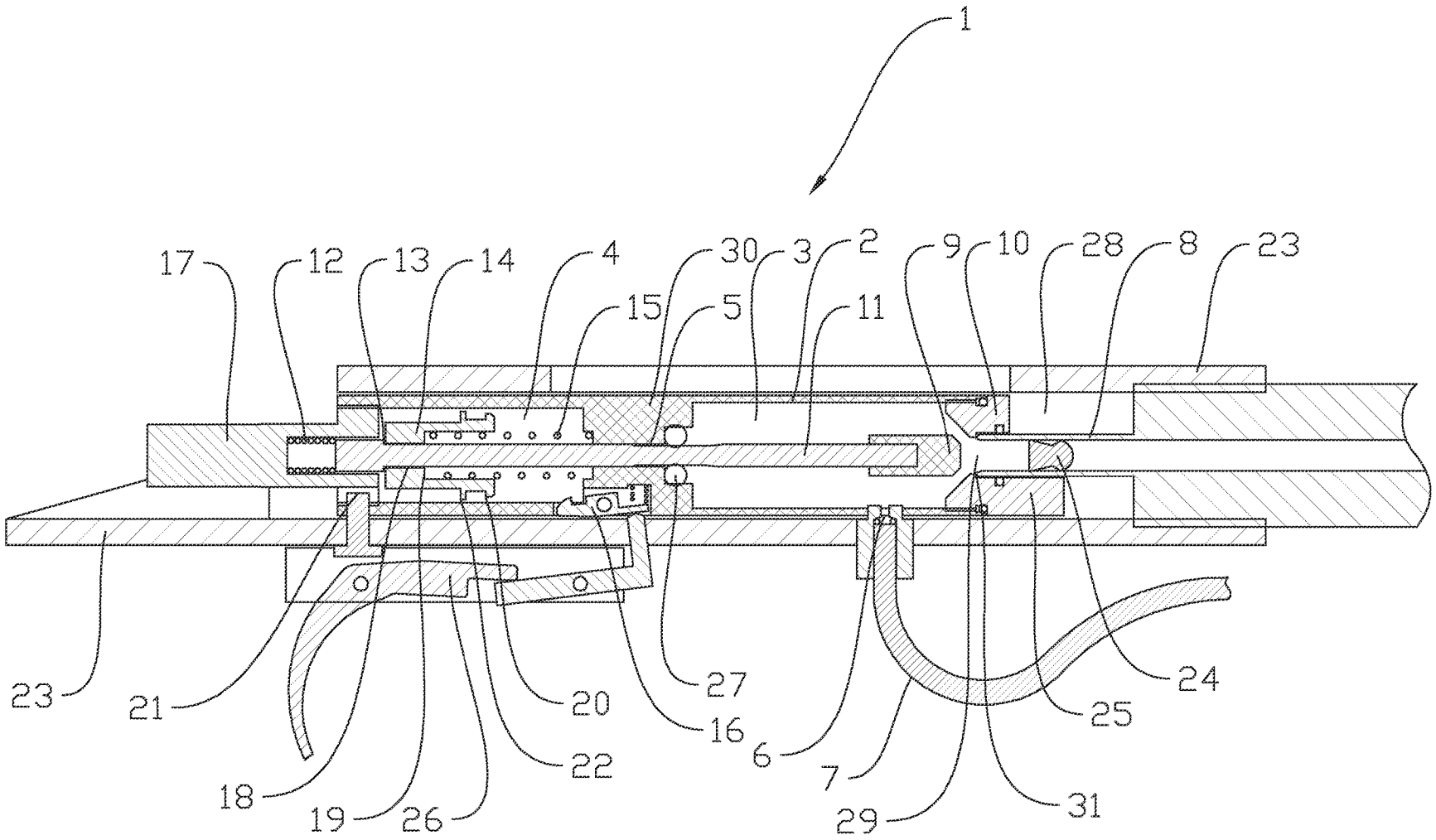

The state of the gun during firing is illustrated in FIG. 3.

The striker catch is released, preferably by the standard trigger mechanism, whereby the compressed spring of the striker positioned in the striker space between the striker and the special section wall separating the pressure chamber and the striker space is released. The spring of the striker expands towards the free striker space, in the opposite direction to that of firing and carries along/strikes the striker. The stricken striker impacts the striker stop of the valve tie rod, by which it is carried along in the opposite direction to that of firing as well. The valve tie rod is pressed by the striker against the lock of the bolt cylinder fitted with the valve tie rod spring and the tie rod compresses the spring. Due to the interconnection of the valve tie rod and the valve, also the valve is moved in the opposite direction to that of firing, fits closely to the seat of the valve and connects the pressure chamber with the barrel.

Pressurized air flows into place with a lower pressure, meaning into the barrel that is for a moment opened due to the opened space between the valve and the seat of the valve, and fires the projectile out of the barrel using all its energy. During firing, the spring of the tie rod is compressed by the tie rod and remains compressed until the force of the pressurized gas flowing from the pressure chamber into the barrel is greater than the force of the compressed spring of the tie rod.

Opening of the valve works similarly to draught at an opened door—as soon as the valve moves away from the seat of the valve and pressurized gas starts flowing from the pressure chamber into the barrel, the flow of pressurized gas keeps the valve opened and the spring of the tie rod in the lock of the bolt cylinder compressed.

The shock pressure of the gas does not need to overcome a system of channels or the loss-making expansion space and the entire energy of pressurized gas is immediately and fully used to fire the projectile from the barrel.

After Firing

Figure 4:
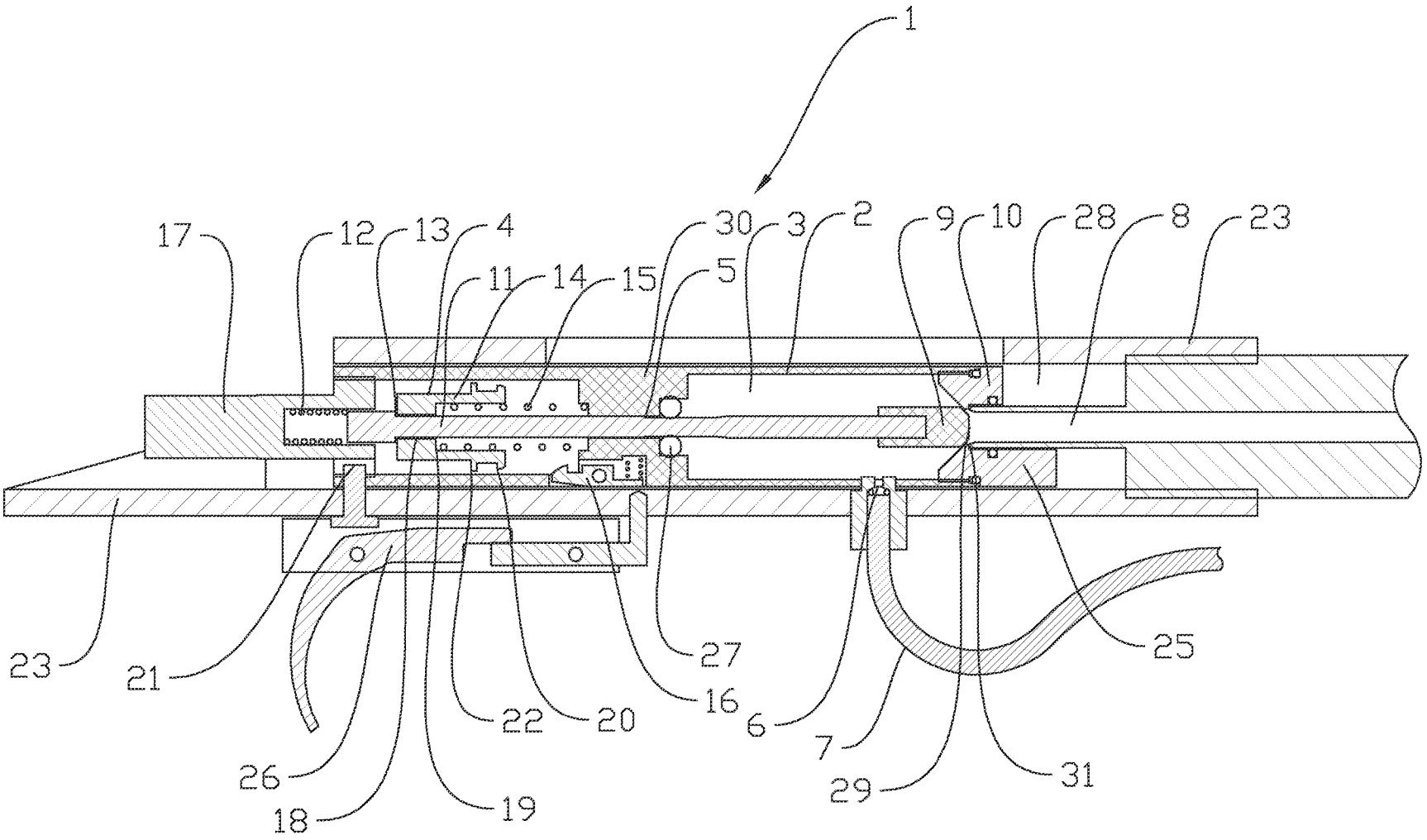

The state of the gun after firing is illustrated in FIG. 4.

Once then pressure of gas in the pressure chamber decreases and the gas flowing from the pressure chamber into the barrel no longer has enough energy to overpress the spring of the tie rod, the tie rod spring expands in the lock of the bolt cylinder to resume its original position and closes the valve or presses away the tie rod of the valve from the lock of the bolt cylinder, respectively towards the barrel, thus allowing the valve to fit closely to the valve seat. This action closes the pressure chamber, the barrel is temporarily separated from the pressure chamber and the pressure chamber is filled up again with pressurized gas through the supply of pressurized air. After firing, both springs—the tie rod spring as well as the striker spring—are released, however they stay preloaded to prevent the components, such as the striker, from free movement within the bolt. The striker remains pressed by the preloaded released spring to be in contact with the striker stop of the valve tie rod. The bolt fits closely to the projectile opening of the barrel. For the next firing, the gun needs to be loaded again.

Thanks to the unique inner arrangement of the gas powered gun according to the present invention with no loss-making expansion space, it is possible to utilize the energy of gas more efficiently compared to the contemporary gas powered guns. In addition, the control of pressure of gas supplied to the pressure chamber, allows a wide range of applications of the gas powered gun. Depending on the set pressure, the gun can be used for firing at short distances, but also for hunting. The gun can also be limited by setting the supplied gas pressure as per the legislation valid in the respective jurisdiction to adjust the performance of the gun accordingly. To compare the gun according to the present invention with contemporary gas powered guns, comparison is provided for the pressure chamber with the volume of 12 ml. The comparison relates to commonly used gas powered gun without home-made improvements and other modifications.

A) Calibre .177 (4.5 mm)—projectile JSB Exact heavy 0.67 g

Pressure chamber size: 12 ml

Pressure: 35 to 40 bar

Attained performance of the gun: 16 J

The commonly used gas powered guns attain this performance—16 J, at the pressure of 70 to 100 bar and higher.

B) Calibre .22 (5.5 mm)—projectile JSB Exact Jumbo heavy 1.175 g

Pressure chamber size: 12 ml

Pressure: approximately 75 bar

Attained performance of the gun: 40 J

The commonly used gas powered guns attain this performance—40 J, at the pressure of 110 to 140 bar and higher.

C) Calibre .22 (5.5 mm)—projectile ATP 2.03 g

Pressure chamber size: 12 ml

Pressure: 155 to 160 bar

Attained performance of the gun: 80 J

The commonly used contemporary gas powered guns with the given volume of pressure chamber generally do not attain this performance. The output of 80 J can be attained by the contemporary gas powered guns only with the use of a larger pressure chamber and a higher pressure. A majority of the commonly used contemporary gas powered guns with factory design and with no additional improvements attain the maximum energy at the calibre of .22, i.e. 50 to 55 J.

D) Calibre .22 (5.5 mm)—projectile JSB Exact Jumbo heavy 1.175 g

Pressure chamber size: 12 ml

Pressure: 190 to 200 bar

Attained performance of the gun: 100 J

The commonly used contemporary gas powered guns with the given volume of pressure chamber generally do not attain this performance. The output of 100 J can be attained by the contemporary gas powered guns only with the use of a larger pressure chamber and a higher pressure. A majority of the commonly used contemporary gas powered guns with factory design and with no additional improvements attain the maximum energy at the calibre of .22, i.e. 50 to 55 J.

The gun according to the present invention attains up to double the output compared to the commonly used gas powered guns with the same volume of pressure chamber and at the same pressure of gas. This is caused by the absence of the loss-making expansion space and direct connection of the pressure chamber to the barrel. The increase in performance is also contributed by the path of pressurized gas where the pressurized gas at firing flows between the valve and the valve seat. The valve is actually closed only after the pressure of pressurized air decreases so much that it is no longer able to overpress the valve tie rod spring. This means that the valve does not throttle the flow of pressurized gas in any manner as it can be seen in the case of standard gas powered guns where at high pressures of pressurized gas the performance of the gun is paradoxically reduced.

Considering the absence of the loss-making expansion space, the improvement of performance is manifested preferably with smaller pressure chambers, in the order of units of millilitres. As the pressure chamber does not need to flood the loss-making expansion space at firing, which would result in pressure losses, even such a small pressure chamber can attain the same output as the standard gas powered guns with larger pressure chambers.

OVERVIEW OF FIGURES IN DRAWINGS

FIG. 1: The gun according to the present invention during loading, inserting the projectile into the gun.

FIG. 2: The gun according to the present invention before firing.

FIG. 3: The gun according to the present invention—firing, the trigger mechanism has fired and the projectile is moving along the barrel.

FIG. 4: The gun according to the present invention after firing.

Figure 5:
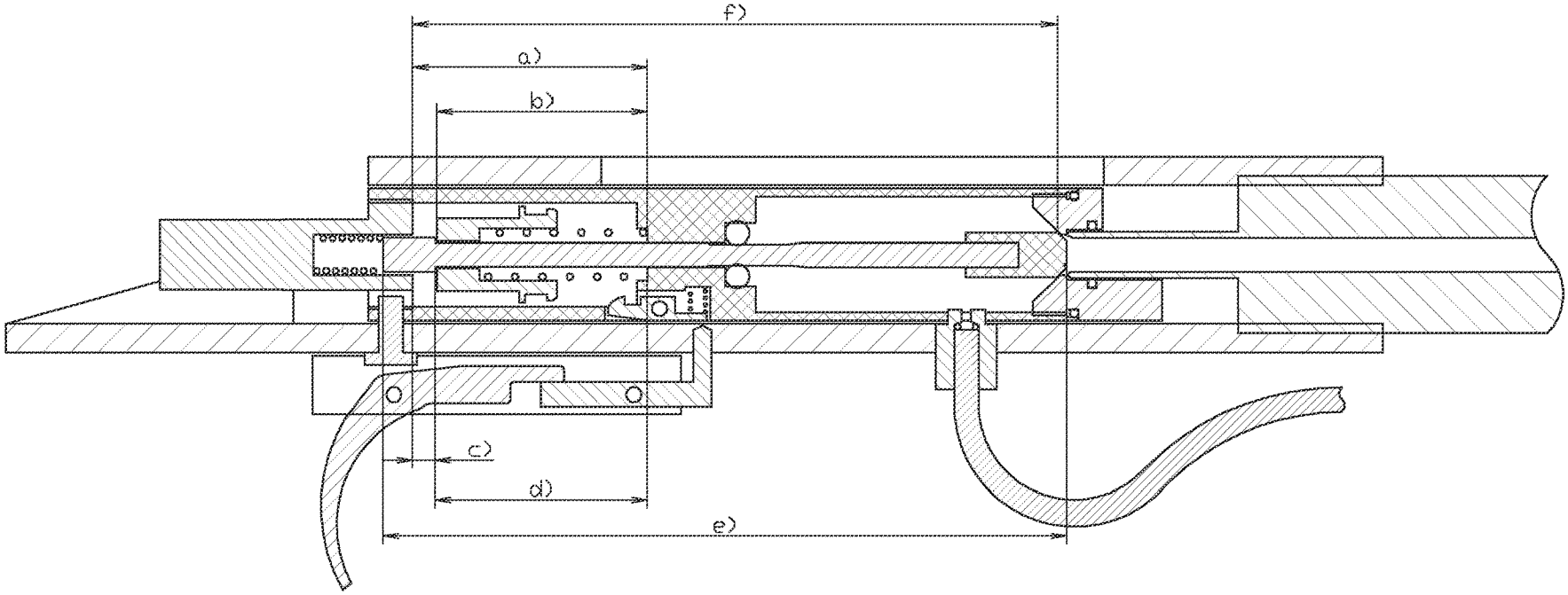

FIG. 5: Definition of dimensions of the gun according to the present invention.

EXAMPLES OF THE INVENTION EMBODIMENTS

Example 1

The Body 23 of the Gas Powered Gun that is Powered by Compressed Gas, with No Loss-Making Expansion Space, where the Body 23 is Positioned in a Movable Bolt Cylinder 2

The duralumin cylinder 2 is equipped with pressure chamber 3 and the striker space. The pressure chamber 3 is directly, through the seat 10 of the valve 9 connected to the projectile opening 29 of the barrel 8, where the connection of the barrel 8—pressure chamber 3 is lockable by the valve 9 fitting closely to the centre of the seat 10 of the valve 9. The valve 9 is connected to the tie rod 11 of the valve 9, which is mounted in one axis with the barrel 8 and passes through the pressure chamber 3. In addition, the tie rod 11 passes through the special section wall 30 separating the pressure chamber 3 from the striker space 4, the striker space 4 and along with the spring 12 of the tie rod 11 it is seated in the lock 17 of the bolt cylinder 2, which closes both the striker space 4 and the entire bolt cylinder 2. In the striker space 4, after passing through the pressure chamber 3 and the special section wall 30, the tie rod 11 of the valve 9 is fitted with the spring 15 of the striker 14, the striker 14 and the stop 13 of the striker 14.

The pressure chamber 3 is manufactured from duralumin, it is turned, milled, or cast in the bolt cylinder 2 and has an irregular inner shape of the volume of 12.7 ml centred around the axis of the barrel 8. The pressure chamber 3 is fitted with the supply 6 of pressurized gas connected by a flexible hose 7 to the source of pressurized gas, meaning the pressurized gas canister. By the supply 6 of pressurized gas, pressurized gas is constantly supplied from the canister. to the pressure chamber 3. The pressure chamber 3 is on its connection to the barrel 8 fitted with a circular seat 10 of the valve 9 made of polished duralumin with a centrally positioned opening and with an inlet contour. The opening of the seat 10 of the valve 9 is closely fitted by the projectile opening 29 of the barrel 8, whereby the seat 10 of the valve 9 is fitted with a centralized section 31 allowing the barrel 8 to be inserted. The seat 10 of the valve 9 is connected with the socket 25 of the projectile 24, which is positioned in the loading space under the barrel 8 closely fitting to the section 31 allowing the barrel 8 to be inserted and has the shape of a half-round groove. When the gun is being loaded, where the valve 9—closed pressure chamber 3 is displaced from the projectile opening 29 of the barrel 8, the projectile 24 is inserted into the half-round groove of the socket 25 of the projectile 24. When the pressure chamber 3 approaches the barrel 8 subsequently, the projectile 24 is inserted from the socket 25 into the projectile opening 29 of the barrel 8 and the projectile opening 29 of the barrel 8 then closely fits to the section 31 for the insertion of the barrel 8 of the seat 10 of the valve 9. The tie rod 11 of the valve 9, which passes through the entire bolt cylinder 2 from the seat 10 of the valve 9 up to the lock 17 of the bolt cylinder 2, is manufactured from steel and has the shape of a rod, meaning a long cylinder with thread in the area where the tie rod 11 of the valve 9 is mounted. The end of the tie rod 11 positioned in the pressure chamber 3 is fitted with the plastic self-centring valve 9 having the shape of a cylinder with inlet contour. The inlet contour of the plastic valve 9 corresponds with the inlet contour of the duralumin seat 10 of the valve 9, thanks to which when the valve 9 fits closely to the seat 10 the opening in the seat 10 is reliably closed. The opening in the seat 10 of the valve 9 has a smaller diameter than that of the valve 9.

Onto the tie rod 11 of the valve 9, after passing through the pressure chamber 3 and the special section wall 30, the spring 15 of the striker 14 is put on, the diameter of which is larger than that of the tie rod 11 of the valve 9. The spring 15 of the striker 14 is partly implanted in the special section wall 30. Then on the tie rod 11 of the valve 9*a* steel striker 14 of the shape of a special section annulus with the seat 19 of the spring 15 of the striker 14 is put, where the spring 15 of the striker 14 is partially implanted in the seat 19 of the spring 15. The inner diameter of the striker 14, or the opening 18 for the tie rod 11 of the valve 9 respectively, is larger than the diameter of the tie rod 11 of the valve 9 and smaller than the diameter of the spring 15 of the striker 14. The outer diameter of the striker 14 is greater than the diameter of the spring 15 of the striker 14. The striker 14 is on its outer case equipped with the annular section 20 for the catch 16 of the striker 14 and with the annular section 22 for the stop 21 of the bolt cylinder 2. The catch 16 of the striker 14 is made of stainless steel and is positioned in the wall of the bolt cylinder 2 at a distance from the special section wall 30 corresponding to the length of the assembly of the striker 14—compressed spring 15 of the striker 14. The catch 16 of the striker 14 is connected to the trigger mechanism 26. Onto the tie rod 11 of the valve 9 is then welded a stop 13 of the striker 14, in the form of two oppositely located steel projections on the tie rod 11 of the valve 9. The stop 13 of the striker 14 has a larger diameter than the inner diameter of the striker 14.

All the disclosed components, with the exception of the barrel 8 are located in the bolt cylinder 2 and together form the bolt 1. After the bolt 1 is mounted in the gun powered by compressed gas, the bolt 1 remains movable in the axis of the barrel 8. The gun is fitted with a static stop 21 of the bolt cylinder 2 positioned at a distance from the special section wall 30 that is greater than the length of the assembly of the striker 14—released spring 15 of the striker 14 and at the same time smaller than the length of the striker space 4. The stop 21 of the bolt cylinder 2 is intended for stopping the moving striker 14 in the bolt cylinder and compressing the spring 15 of the striker 14.

In Action:

Before firing, it is necessary to displace the bolt 1 away from the barrel 8 to expose the loading space 28 and the socket 25 of the projectile 24. Along with the bolt cylinder 2, all components positioned therein move, until the section 22 for the stop 21 of the bolt cylinder 2 strike against the stop 21 of the bolt cylinder 2. At this moment the striker 14 is stopped in its movement, regardless of the fact that the bolt cylinder 2 continues moving away from the barrel 8. Thanks to this, the spring 15 of the striker 14, which is positioned between the striker 14 and the special section wall 30 that is moving along with the bolt cylinder 2, is compressed. When the spring 15 of the striker 14 is compressed and the section 20 for the catch 16 of the striker 14 positioned on the striker 14 and the catch 16 of the striker 14 positioned in the wall of the still moving bolt cylinder 2 approach one another, the catch 16 catches the section 20 and secures the striker 14 with the compressed spring 15 of the striker 14. For live firing, the projectile 24 is inserted into the socket 25 of the projectile 24. The entire bolt 1 with the secured striker 14 and the compressed spring 15 of the striker 14 returns along its axis, or the axis of the barrel 8 respectively, to the projectile opening 29 of the barrel 8, to which it is connected again. If the projectile 24 is inserted into the socket 25 of the projectile 24, then when the bolt 1 approaches the projectile opening 29 of the barrel 8, the projectile 24 is inserted into the projectile opening 29 of the barrel 8.

For firing, it is necessary to release the striker 14, or the striker spring 15. This is attained by releasing the catch 16 of the striker 14 connected to the trigger mechanism 26, by which also the spring 15 of the striker 14 is released and throws the striker 14 towards the stop 13 of the striker 14 in the opposite direction of firing. The striker 14 strikes the stop 13 of the striker 14 and thanks to the kinetic energy transferred to the striker 14 by the spring 15 of the striker 14 the tie rod 11 of the valve 9 is carried along with the striker 14 stricken by the stop 13 of the striker 14 in the direction opposite to that of firing. The moving tie rod 11 of the valve 9 pulls away the valve 9 closely fitting to the seat 10 of the valve 9, thus opening the mutually connected pressure chamber 3 and the barrel 8. Pressurized air from the pressure chamber 3 flows around the valve 9 and the seat 10 of the valve 9 into the barrel 8, by which firing is implemented. If in the projectile opening 29 of the barrel 8 projectile 24 is placed, the projectile 24 is fired from the barrel 8 with the full force of the pressurized air from the immediately adjacent pressure chamber 3.

Example 1B

The Body 23 of the Gas Powered Gun that is Powered by Compressed Gas, with No Loss-Making Expansion Space, where the Body 23 is Positioned in a Movable Bolt Cylinder 2

The duralumin cylinder 2 is equipped with pressure chamber 3 and the striker space. The pressure chamber 3 is directly, through the seat 10 of the valve 9 connected to the projectile opening 29 of the barrel 8, where the connection of the barrel 8—pressure chamber 3 is lockable by the valve 9 fitting closely to the centre of the seat 10 of the valve 9. The valve 9 is connected to the tie rod 11 of the valve 9, which is mounted in one axis with the barrel 8 and passes through the pressure chamber 3. In addition, the tie rod 11 passes through the special section wall 30 separating the pressure chamber 3 from the striker space 4, the striker space 4 and along with the spring 12 of the tie rod 11 it is seated in the lock 17 of the bolt cylinder 2, which closes both the striker space 4 and the entire bolt cylinder 2. In the striker space 4, after passing through the pressure chamber 3 and the special section wall 30, the tie rod 11 of the valve 9 is fitted with the spring 15 of the striker 14, the striker 14 and the stop 13 of the striker 14.

The pressure chamber 3 is manufactured from duralumin. It is turned, milled, or cast in the bolt cylinder 2 and has an irregular inner shape of the volume of 2 ml centred around the axis of the barrel 8. The pressure chamber 3 is fitted with the supply 6 of pressurized gas connected by a flexible hose 7 to the source of pressurized gas, meaning the pressurized gas canister. By the supply 6 of pressurized gas, pressurized gas is constantly supplied from the canister to the pressure chamber 3 through the pressure controller. The pressure chamber 3 is on its connection to the barrel 8 fitted with a circular seat 10 of the valve 9 made of polished brass with a centrally positioned opening and with an inlet contour. The opening of the seat 10 of the valve 9 is closely fitted by the projectile opening 29 of the barrel 8, whereby the seat 10 of the valve 9 is fitted with a centralized section 31 allowing the barrel 8 to be inserted. The seat 10 of the valve 9 and the socket 25 of the projectile 24 form one component, where the socket 25 of the projectile 24 is positioned in the loading space under the barrel 8 closely fitting to the section 31 allowing the barrel 8 to be inserted and has the shape of a half-round groove. When the gun is being loaded, closed pressure chamber 3 is displaced from the projectile opening 29 of the barrel 8, the projectile 24 is inserted into the half-round groove of the socket 25 of the projectile 24. When the pressure chamber 3 approaches the barrel 8 subsequently, the projectile 24 is inserted from the socket 25 into the projectile opening 29 of the barrel 8 and the projectile opening 29 of the barrel 8 then closely fits to the section 31 for the insertion of the barrel 8 of the seat 10 of the valve 9.

The tie rod 11 of the valve 9, which passes through the entire bolt cylinder 2 from the seat 10 of the valve 9 up to the lock 17 of the bolt cylinder 2, is manufactured from steel and has the shape of a screw, meaning a long threaded cylinder, and the tie rod is extended in the area of the stop 13 of the striker. This means that the stop 13 of the striker 14 and the tie rod 11 of the valve 9 are made of one piece. The end of the tie rod 11 positioned in the pressure chamber 3 is fitted with the brass self-centring valve 9 having the shape of a cylinder with inlet contour and with silicone seal, where the valve 9 is screwed onto the tie rod. The inlet contour of the brass valve 9 corresponds with the inlet contour of the brass seat 10 of the valve 9, thanks to which when the valve 9 fits closely to the seat 10 the opening in the seat 10 is reliably closed. The opening in the seat 10 of the valve 9 has a smaller diameter than that of the valve 9. Onto the tie rod 11 of the valve 9, after passing through the pressure chamber 3 and the special section wall 30, the spring 15 of the striker 14 is put on, the diameter of which is larger than that of the tie rod 11 of the valve 9. The spring 15 of the striker 14 is partly implanted in the special section wall 30. Then on the tie rod 11 of the valve 9*a* bronze striker 14 of the shape of a special section annulus with the seat 19 of the spring 15 of the striker 14 is put, where the spring 15 of the striker 14 is partially implanted in the seat 19 of the spring 15. The inner diameter of the striker 14, or the opening 18 for the tie rod 11 of the valve 9 respectively, is larger than the diameter of the tie rod 11 of the valve 9 and smaller than the diameter of the spring 15 of the striker 14. The outer diameter of the striker 14 is greater than the diameter of the spring 15 of the striker 14. The striker 14 is on its outer case equipped with the annular section 20 for the catch 16 of the striker 14 and with the annular section 22 for the stop 21 of the bolt cylinder 2. The catch 16 of the striker 14 is made of stainless steel and is positioned in the wall of the bolt cylinder 2 at a distance from the special section wall 30 corresponding to the length of the assembly of the striker 14—compressed spring 15 of the striker 14. The catch 16 of the striker 14 is connected to the trigger mechanism 26. The stop 13 of the striker 14 has a larger diameter than the inner diameter of the striker 14.

All the disclosed components, with the exception of the barrel 8 are located in the bolt cylinder 2 and together form the bolt 1. After the bolt 1 is mounted in the gun powered by compressed gas, the bolt 1 remains movable in the axis of the barrel 8. The gun is fitted with a static stop 21 of the bolt cylinder 2 positioned at a distance from the special section wall 30 that is greater than the length of the assembly of the striker 14—released spring 15 of the striker 14 and at the same time smaller than the length of the striker space 4. The stop 21 of the bolt cylinder 2 is intended for stopping the moving striker 14 in the bolt cylinder and compressing the spring 15 of the striker 14.

Example 2

The System of Direct Connection of the Pressure Chamber to the Barrel

The projectile opening 29 of the barrel 8 opens directly to the pressure chamber 3, where the connection of the barrel 8—pressure chamber 3 is lockable by the valve 9 closely fitting to the centre of the circular seat 10 of the valve 9. The valve 9 is connected to the tie rod 11 of the valve 9, which is mounted in one axis with the barrel 8 and passes through the pressure chamber 3. After passing through the pressure chamber 3 the tie rod 11 of the valve 9 is fitted with the spring 15 of the striker 14, the striker 14 and the stop 13 of the striker 14. By the movement of the tie rod 11 of the valve 9 back and forth the valve 9 moves away and to the seat 10 of the valve 9, thus interconnecting and separating the pressure chamber 3 and the barrel 8.

The pressure chamber 3 is made of steel, has the shape of a hollow cylinder capped on both ends, with the volume of 50 ml and is fitted with the supply 6 of pressurized gas, through which pressurized gas constantly flows from the canister to the pressure chamber 3. One of the basis of the hollow cylinder of the pressure chamber 3 is comprised of the seat 10 of the valve 9 with the circular shape with a centrally positioned opening made of rubber. The opening of the seat 10 of the valve 9 is closely fitted by the projectile opening 29 of the barrel 8, thus interconnecting the pressure chamber 3 and the barrel 8. The other basis of the hollow cylinder of the pressure chamber 3 is formed by a steel wall 30 with a central opening—port 5 for mounting the tie rod 11 of the valve 9. Through the port 5 the steel tie rod 11 of the valve in the shape of a capped hollow rod passes to the pressure chamber 3. The end of the tie rod 11 positioned in the pressure chamber 3 is fitted with the valve 9 having the shape of a cylinder made of rubber. The diameter of the valve 9 is greater than the central opening in the seat 10 of the valve 9 and the valve 9 fits closely to the central opening of the seat 10 of the valve 9 as a cork.

Onto the tie rod 11 of the valve 9 projecting from the pressure chamber 3 the spring 15 of the striker 14 is put on, the diameter of which is greater than that of the tie rod 11 of the valve 9. Then on the tie rod 11 of the valve 9*a* steel striker 14 having the shape of an annulus is put on, which tightly fits to the spring 15 of the striker 14. The inner diameter of the striker 14 is greater than that of the tie rod 11 of the valve 9 and smaller than that of the spring 15 of the striker 14. The outer diameter of the striker 14 is greater than the diameter of the spring 15 of the striker 14. Onto the tie rod 11 of the valve 9 is then put on a stop 13 of the striker 14 having the shape of an annulus made of steel that is welded onto the tie rod 11 of the valve 9. The stop 13 of the striker 14 has the inner diameter greater by 1 mm than that of the tie rod 11 of the valve 9 and the outer diameter greater than the inner diameter of the striker 14. Before firing it is necessary to compress the tie rod 11 of the valve 9 in the direction of firing into the seat 10 of the valve 9 thus closing the connection between the pressure chamber 3 and the barrel 8. The pressure chamber 3 connected to the supply 6 of pressurized gas immediately fills with pressurized gas. Then it is necessary to displace the striker 14 against the force of the spring 15 of the striker 14 thus compressing the spring 15 of the striker 14.

For firing it is necessary to release the striker 14, which also release the spring 15 of the striker 14, throwing the striker 14 towards the stop 13 of the striker 14 in the opposite direction of firing. The striker 14 strikes the stop 13 of the striker 14 and thanks to the kinetic energy transferred to the striker 14 by the spring 15 of the striker 14 the tie rod 11 of the valve 9 is carried along with the striker 14 stricken by the stop 13 of the striker 14 in the direction opposite to that of firing. The moving tie rod 11 of the valve 9 pulls away the valve 9 closely fitting to the seat 10 of the valve 9, thus opening the mutually connected pressure chamber 3 and the barrel 8. Pressurized air from the pressure chamber 3 flows around the valve 9 and the seat 10 of the valve 9 into the barrel 8, by which mock ammunition is fired.

For live firing, it is necessary to insert the projectile 24 into the projectile opening 29 of the barrel 8. Upon firing, the projectile 24 is fired out of the barrel 8 utilizing the full force of pressurized air flowing from the immediately neighbouring pressure chamber 3.

REFERENCE SIGNS LIST

1. Bolt
2. Bolt cylinder
3. Pressure chamber
4. Striker space
5. Port for mounting the tie rod 11 of the valve 9
6. Pressurized gas supply
7. Flexible hose
8. Barrel
9. Valve
10. Seat of the valve 9
11. Tie rod of the valve 9
12. Spring of the tie rod 11 of the valve 9
13. Stop of the striker 14
14. Striker
15. Spring of the striker 14
16. Catch of the striker 14
17. Lock of the bolt cylinder 2
18. Opening for the tie rod 11 of the valve 9
19. Seat of the spring 15 of the striker 14
20. Section for the catch 16 of the striker 14
21. Stop of the bolt cylinder 2
22. Section for the stop 21 of the bolt cylinder 2
23. Body of the gas powered gun
24. Projectile
25. Socket of the projectile 24
26. Trigger mechanism for the catch 16 of the striker 14
27. Seal of the pressure chamber 3
28. Loading space
29. Projectile opening of the barrel 8
30. Special section wall separating the pressure chamber 3 and the striker space 4
31. Section for inserting the barrel 8
a) Length of the striker space
b) Length of the assembly the striker 14—relaxed spring 15 of the striker 14
c) Distance of the stop 13 of the striker 14 from the lock 17 of the bolt cylinder 2
d) Distance of the stop 13 of the striker 14 from the special section wall 30
e) Length of the assembly the tie rod of the valve fitted with the valve—released spring of the tie rod
f) Length of the assembly the pressure chamber—port—striker space—inner space of the lock 17 of the bolt cylinder 2

INDUSTRIAL APPLICABILITY

Hunting, sports and recreational shooting, guns powered by compressed gaseous medium, in particular with high performance

The invention claimed is:

1. A gas powered gun powered by compressed gas with no loss-making expansion space, comprising:
a pressure chamber (3) interconnected with a barrel (8), and
a projectile opening (29) of the barrel (8) at an inlet of the pressure chamber (3),
the pressure chamber (3) and the barrel (8) being mutually lockable by a valve (9), wherein upon firing the gun:
the pressure chamber (3) and the barrel (8) form one space,
the valve (9) is connected to a tie rod (11),
the valve (9) passes through the pressure chamber (3) to a striker space (4),
wherein within the striker space:
the tie rod (11) is fitted with a spring (15) of a striker (14),
the striker (14) and an end of the tie rod (11) are equipped with a stop (13) of the striker (14) and the spring (15) of the striker (14) is positioned in the striker space (4)

between the striker (14) and a special section wall (30) separating the pressure chamber (3) from the striker space (4), and wherein:

the barrel (8), tie rod (11), valve (9), and striker (14) are mounted along one axis, and the valve (9) connecting the pressure chamber (3) and the barrel (8) is controlled by the striker (14) via the tie rod (11).

2. The gas powered gun of claim 1, wherein the pressure chamber (3), valve (9), tie rod (11) striker space (4), spring (15) of the striker (14), striker (14), and the stop (13) of the striker (14) are positioned in a movable bolt cylinder (2).

3. The gas powered gun of claim 2, wherein the movable bolt cylinder (2) is locked by a lock (17) of the bolt cylinder (2) fitted with a spring (12) of the tie rod (11).

4. The gas powered gun of claim 1, wherein the spring (15) of the striker (14) is partially or fully implanted in the striker (14) in a seat (19) of the spring (15) of the striker (14).

5. The gas powered gun of claim 1, wherein the spring (15) of the striker (14) is partially or fully implanted in the special section wall (30) separating the pressure chamber (3) from the striker space (4).

6. The gas powered gun of claim 1, wherein the pressure chamber (3) is, on the connection with the barrel (8), equipped with a seat (10) of the valve (9), wherein the valve (9) fits closely with the seat (10) of the valve (9), and the valve (9) and the seat (10) of the valve (9) have corresponding inlet contours.

7. The gas powered gun of claim 1, wherein the tie rod (11) is, upon its passage through the pressure chamber (3), sealed by a seal (27), and the special section wall (30) comprises a port (5) for mounting the tie rod (11).

8. The gas powered gun of claim 1, wherein the striker (14) comprises a section (20) for a catch (16) of the striker (14) on a movable bolt cylinder (2) connected to a trigger mechanism (26).

9. The gas powered gun of claim 1, wherein the tie rod (11) fits closely to a spring (12) of the tie rod (11), on a side opposite to that where the valve (9) is positioned.

10. The gas powered gun of claim 1, wherein the pressure chamber (3), positioned inside a movable bolt cylinder (2), is fitted with a supply (6) of pressurized gas, the pressure chamber (3) being connected to a source of pressurized gas by a flexible hose (7).

11. The gas powered gun of claim 1, wherein the striker (14) is put on the tie rod (11) through an opening (18) for the tie rod (11).

12. The gas powered gun of claim 1, wherein the striker (14) comprises a section (22) for a stop (21) of the bolt (1).

13. The gas powered gun of claim 1, comprising a bolt cylinder (2), in a loading space (28), the bolt cylinder (2) comprising a socket (25) of the projectile that is part of a seat (10) of the valve (9).

14. The gas powered gun of claim 9, wherein a seat (10) of the valve (9) comprises a section (31) for insertion of the barrel (8).

* * * * *